US007905272B2

(12) United States Patent
Albrecht et al.

(10) Patent No.: US 7,905,272 B2
(45) Date of Patent: Mar. 15, 2011

(54) METHOD AND DEVICE FOR THE PRODUCTION OF WIDE STRIPS OF COPPER OR COPPER ALLOYS

(75) Inventors: Michael Albrecht, Walbeck (DE); Joachim Dauterstedt, Osterhausen (DE); Hans-Jürgen Schütt, Hettstedt (DE); Michael Starke, Ritterode (DE)

(73) Assignee: MKM Mansfelder Kupfer und Messing GmbH, Hettstedt (DE)

( * ) Notice: Subject to any disclaimer, the term of this patent is extended or adjusted under 35 U.S.C. 154(b) by 80 days.

(21) Appl. No.: 12/519,173

(22) PCT Filed: Dec. 8, 2007

(86) PCT No.: PCT/EP2007/010695

§ 371 (c)(1),
(2), (4) Date: Jun. 15, 2009

(87) PCT Pub. No.: WO2008/071357

PCT Pub. Date: Jun. 19, 2008

(65) Prior Publication Data

US 2010/0101749 A1 Apr. 29, 2010

(30) Foreign Application Priority Data

Dec. 14, 2006 (EP) ..... 06025918

(51) Int. Cl.
*B22D 11/10* (2006.01)
*B22D 11/18* (2006.01)

(52) U.S. Cl. ..... 164/488; 164/437; 164/453; 164/479; 222/591; 222/594; 222/606

(58) Field of Classification Search ..... 164/437, 164/453, 479, 488; 222/591, 594, 606
See application file for complete search history.

(56) References Cited

U.S. PATENT DOCUMENTS

| | | | | | |
|---|---|---|---|---|---|
| 4,475,583 | A | * | 10/1984 | Ames | 164/423 |
| 4,915,270 | A | * | 4/1990 | Daniel et al. | 222/606 |
| 4,972,900 | A | * | 11/1990 | Szczypiorski | 164/481 |
| 5,613,547 | A | * | 3/1997 | Lauener | 164/437 |
| 5,755,274 | A | * | 5/1998 | Maiwald et al. | 164/479 |
| 6,095,383 | A | * | 8/2000 | Smith | 222/594 |
| 2006/0191664 | A1 | * | 8/2006 | Sulzer et al. | 164/481 |

* cited by examiner

*Primary Examiner* — Kevin P Kerns
*Assistant Examiner* — Devang R Patel
(74) *Attorney, Agent, or Firm* — Laurence A. Greenberg; Werner H. Stemer; Ralph E. Locher

(57) ABSTRACT

A method for producing wide strips of copper is performed by pouring a molten liquid into a revolving wide strip mold via a distribution container and a pour nozzle. A surface of the molten metal in the distribution container is maintained at a constant level above the place where the pour nozzle is fixed in the distribution container in the range of 75 mm to 90 mm with respect to the level of the bath surface of the mold. The molten metal is guided by an ascending channel from the distribution container to the pour nozzle and is distributed within the pour nozzle symmetrically over a width corresponding to the width of the strip. Within the pour nozzle, the molten metal is guided through first and second flow restrictors and is separated into numerous small individual flows in a vertical direction over the entire strip width of the mold.

20 Claims, 5 Drawing Sheets

METHOD AND DEVICE FOR THE PRODUCTION OF WIDE STRIPS OF COPPER OR COPPER ALLOYS

BACKGROUND OF THE INVENTION

Field of the Invention

The invention relates to a method for the production of wide strips of copper or copper alloys by pouring a molten liquid into a revolving wide strip mold, and a device suitable for carrying out the method consisting of a distribution container and a pour nozzle for the feeding of the liquid molten metal into the wide strip mold.

The production of wide strips involves guiding the molten liquid contained in a distribution container (tundish) into the lower wide strip mold by means of one or more pouring spouts and channels or pour nozzles. Different versions of devices for feeding a molten metal from a distribution container or tundish into a mold are already known. The molten metal in the tundish is guided into the molten bath, the pool, of the revolving wide strip mold by one or more pouring spouts and channels. The pouring spout and channel can be arranged vertically or at a defined angle inclined to the horizontal. The purpose of the pouring spouts and channels is to ensure the molten metal is distributed in the wide strip mold evenly and with minimum turbulence. An adequate filling level in the tundish ensures that the pouring spout and channel are completely filled with molten metal. The flow rate of the molten metal is affected by the metallostatic pressure of the molten metal in the tundish, dependent on the pouring angle of the pouring spout and channel. With increasing acceleration of the molten metal in the pouring spout and channel, a negative pressure is produced, leading to turbulences and fluctuations in the bath level of the molten metal in the pool of the wide strip mold.

Many of the known pouring spouts and channels are submerged tubes which are immersed in the molten bath of the mold and distribute the molten metal fed in beneath the bath surface.

A submerged tube for pouring molten metal is known from DE 101 13 206 A1. This has a turbulence chamber widening in a funnel-shaped manner for dissipating the kinetic energy of the molten metal at the outlet of the submerged tube. The killed melt reaches the pool through side outlets. The submerged tube is arranged vertically and has a flow disruptor at the transition from the tube section to the turbulence chamber.

A pouring system is known from EP 1 506 827 A1 for a thin slab mold with a tundish and a submerged pouring tube and channel in which the submerged tube tapering in the direction of the flow is arranged running diagonally downwards. The outlet of the submerged tube is located below the bath surface of the mold. The outlet is covered by a lip and arranged in such a manner that the molten metal is redirected repeatedly and distributed diagonally to the longitudinal axis of the mold.

With the known devices with submerged tubes running at an angle from the tundish into the lower mold, it is a requirement that the submerged tube be filled full of molten metal.

These devices cause entrapments in the flat products to be produced, leading to an impairment in quality.

A double strip continuous pouring mold is known from EP 0 194 327 A1. The tundish is connected to the pouring spout and channel by a connecting tube bent at right angles. The pouring spout and channel consist of a section running horizontally and a section bent upwards which flows into the mold, with the outlet not being immersed in the pool. The melt flow is repeatedly redirected up to its entry into the mold by the siphon-like arrangement of tundish, connecting tube and pouring spout and channel. A special device for regulating the position of the meniscus is provided to prevent external air getting into the mold chamber.

A pouring device is described in DE 40 39 959 C1 in which the molten metal is guided from the tundish into the mold by a channel running diagonally downwards, with a linear induction motor arranged above the channel to restrict the flow rate of the molten metal. This solution is associated with a high level of expenditure.

It is known that vertically arranged submerged tubes are fitted with mechanical flow restrictors to improve the filling of the interior of the pouring spout and channel by reducing the flow rate (EP 0 950 451 B1).

It was found in practice that considerable problems arose in producing strips with a width of 800 to 1500 mm and a thickness of 20 to 50 mm by pouring a copper melt into a wide strip mold using submerged tubes. Owing to the flow rate of the molten metal fed in below the bath surface, turbulences occur in the pool even at a small inclination of the submerged tubes, causing gas bubbles and oxidic and other impurities collecting on the surface to be flushed into the molten metal. These lead to cavities and cracks in the mold structure of the finished strip.

Compared with other non-ferrous metals, additional special difficulties caused by an intermetallic high temperature corrosion and high oxygen affinity arise when pouring copper or copper alloys because of material properties specific to these metals.

BRIEF SUMMARY OF THE INVENTION

The aim of the invention is to devise a method for the production of wide strips from copper or copper alloys by pouring a liquid molten metal into a revolving wide strip mold, enabling a mold structure of higher quality to be produced. In addition, a device suitable for carrying out the method is to be devised. The technical aspects associated with the above aim are solved in accordance with the invention by means of the features specified in claim 1. Advantageous embodiments and modifications of the method are the subjects of claims 2 to 9. Claim 10 relates to a device suitable for carrying out the method. Advantageous embodiments of the device are the subjects of claims 11 to 20.

The method proposed comprises the following measures:

The surface of molten metal in the distribution container is maintained at a constant level (H) above the place where the pour nozzle is fixed in the distribution container in the range of 75 mm to 90 mm with respect to the level of the bath surface of the mold. The liquid molten metal in the distribution container or tundish is guided from the distribution container to the pour nozzle by an ascending channel. Dependent on the design of the tundish, the ascending channel can be arranged in the corresponding side wall of the tundish. It may be advantageous in certain applications to arrange for the molten metal to flow through another channel running parallel to the horizontal before it enters the pour nozzle, with the channel preferably being extended in width in the direction of flow. The rate of flow of the molten metal can be reduced as it flows through this channel.

The cross section of the channel should preferably be designed in such a manner that a ratio of flow rate to volume flow of 1:4 to 1:3 and 1:1.5 to 1:2 is maintained at the entry and exit points respectively.

On entering the pour nozzle, the molten metal flow is distributed within the pour nozzle (14) symmetrically over a width corresponding to the width of the strip to be produced.

The molten metal is guided within the pour nozzle through at least one first flow restrictor in order to dissipate the kinetic energy of the molten metal flow. The flow rate is reduced downstream of the flow restrictor and an even volume flow is established extending over the entire width. As the molten metal flows through the flow restrictor, it is evenly thermally loaded. This makes it possible to prevent deformations of the pour nozzle caused by material stresses. The advantage of the increase in temperature undergone by the molten metal lies in the fact that it is unnecessary to continuously heat the pour nozzle during pouring.

The molten metal is redirected at the exit point of the pour nozzle through another flow restrictor in the direction of the mold bath surface and is separated into numerous small individual flows in a vertical direction over the entire strip width of the mold. These individual flows are carried into the molten metal bath of the mold (1) as a laminar flow which forms a wedge-type outflow profile with an opening angle running in the direction of discharge of the strip of between 15° to 30° to the bath surface (7) of the mold (1).

The above-mentioned measures result in a flow rate after discharge of the molten metal from the outlet flow restrictor which corresponds approximately to the strip speed of the mold, and is below 0.1 m/s. The molten metal reaches the mold as a laminar flow which forms a wedge-type outflow profile. This practically eliminates turbulences in the pool of the mold. An even heat input, which has an advantageous effect on casting quality, is supplied over the entire width of the mold by the outflow profile formed as a molten metal wedge. The danger of cavities and cracks developing in the mold structure is therefore substantially reduced. The maximum thickness of the outflow profile extending over the cross section width of the strip can vary, but should be at least smaller or have the same thickness as the strip to be poured.

The pour nozzle can be arranged differently in relation to the bath surface in accordance with the respective process-related basic conditions such as dimensions of the strip, pouring output and composition of the molten metal being poured.

The outlets of the pour nozzle can be positioned above the bath surface of the mold. The distance between the outlet flow restrictor of the pour nozzle and the bath surface at the smallest point should be at a ratio of distance/thickness of 1:1.5 to 1:1.1, dependent on the thickness of the strip to be poured. The difference in level between the discharge strip or the outlet flow restrictor and bath surface should preferably be ≦10 mm.

The outlets of the pour nozzle in a further model variant are partly immersed in the bath surface of the mold. In this case only the front outlets of the discharge strip are completely above the bath surface. The outlets can be arranged in the form of several rows running at right angles to the direction of motion of the strip.

The first flow restrictor is designed in such a manner as regards material thickness and the cross sectional areas of the openings that a ratio of the cross sectional area of the spout to the volume flow of 1:8 to 1:12 is maintained, with the cross sectional area of the spout being derived from the sum of the individual cross sectional areas of the opening of the flow restrictor. The flow path length within the flow restrictor is determined by the material thickness of the supply and outlet flow restrictor. This makes it possible to selectively influence the flow rate of the molten metal by using flow paths of different lengths. The pouring unit of the device intended for carrying out the method is arranged in such a manner that there is a difference in level of 70 to 95 mm between the bath surface of the mold and the filling level. This makes it possible to restrict the flow rate of the molten metal to a low level.

In accordance with the design of the distribution container, the molten metal is to flow out of the distribution container through an ascending pouring channel, whose inlet is in the immediate vicinity of the base of the distribution container. This ensures that the liquid level in the distribution container can be kept to a low level, thereby ensuring that the metallostatic pressure is low, and that no air is introduced as the molten metal flows out. The ascending channel is arranged in the front wall section of the distribution container pointing in the direction of the mold.

The pour nozzle has a distribution section and a discharge section, with the distribution section increasing in width to the width of the strip to be poured. A first flow restrictor extending over the entire cross sectional area with throughflowable openings is arranged between the distribution section and the discharge section. These openings are preferably arranged in a row, either immediately bordering the base section or at a short distance from the base of the pour nozzle.

The discharge section has a spout tapering in the direction of the mold. The lower limit of the spout runs diagonally upwards at a defined angle and is fitted as a discharge strip with openings pointing in the direction of the bath surface. The discharge strip or outlet flow restrictor is arranged at an opening angle of 15 to 30° to the bath surface of the mold. The lowest point of the discharge strip is preferably located above the bath surface at a distance corresponding to 0.9 to 0.5 times the thickness of the strip to be poured. The gap should however preferably be kept short and should not exceed 10 mm. With special copper alloys the short gap prevents a possible "freezing" of the molten metal. It can also be advantageous in certain applications if the lowest point of the discharge strip is in contact with the bath surface or is partly immersed in it.

The outlets of the discharge strip can be differently formed and arranged, e.g. in the form of rows with openings of identical or different cross sections, in accordance with the flow rate to be achieved.

The pour nozzle and distribution container can also be connected by a connecting piece to a pouring channel running parallel to the horizontal and increasing continuously in width in the direction of flow. The connecting piece can also be an integrated component of the distribution container. The purpose of the interposed flow path is to ensure that the kinetic energy of the flow rate is dissipated at this section. The measures proposed can, for example, reduce the flow rate of the liquid molten metal at the outlet of the tundish by about 10 to 20 times in the production of an endless strip with a width of 1290 mm and a thickness of 40 mm, corresponding to a pouring output of about 55 t/h.

The flow rate of the molten metal discharging from the pour nozzle can therefore be adjusted to the speed of the strip.

The invention is to be explained below using an execution example.

The drawings show the following:

DESCRIPTION OF THE INVENTION

Figure 1:
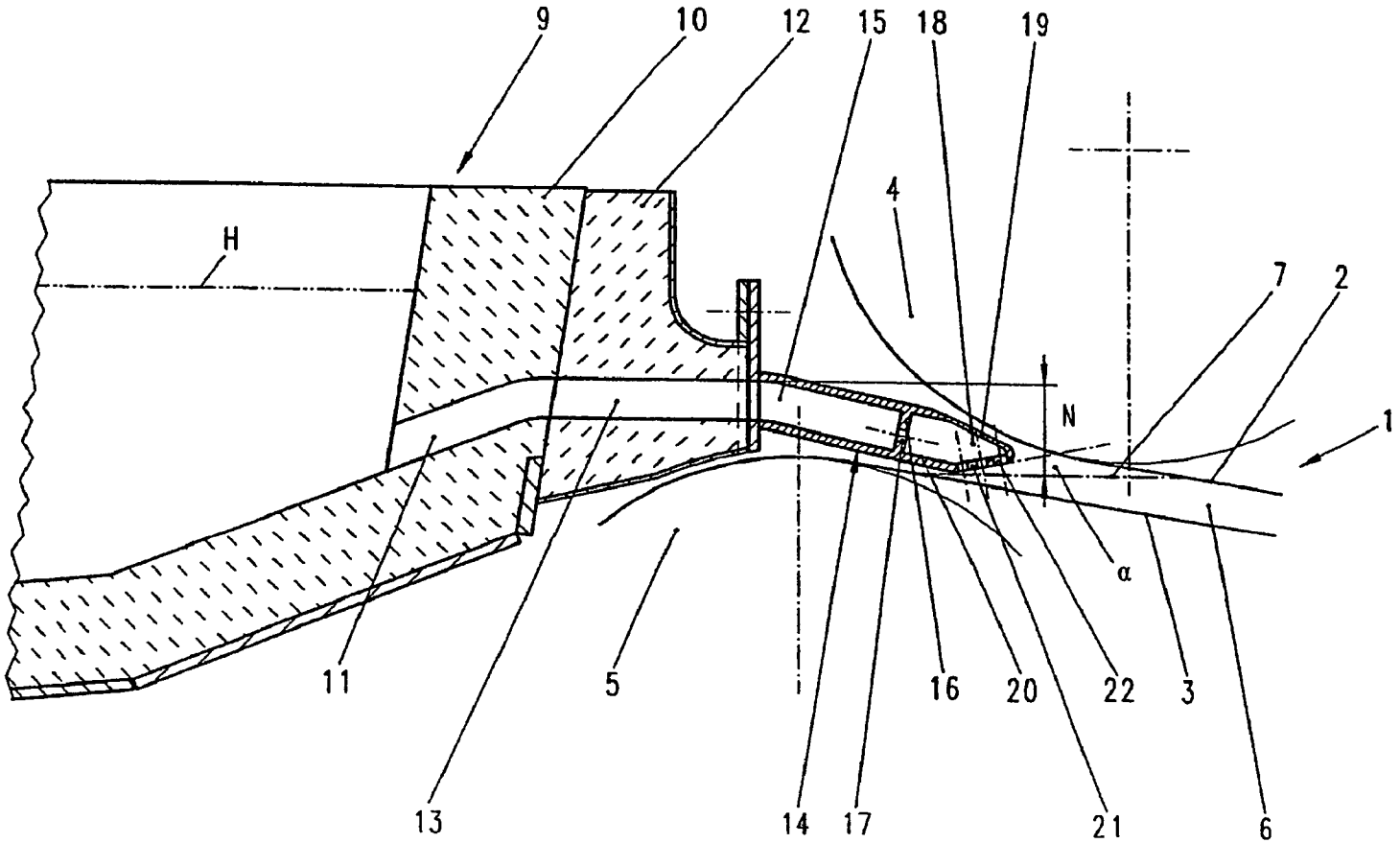
FIG. 1 simplified diagram of the device in longitudinal section.
Figure 2:
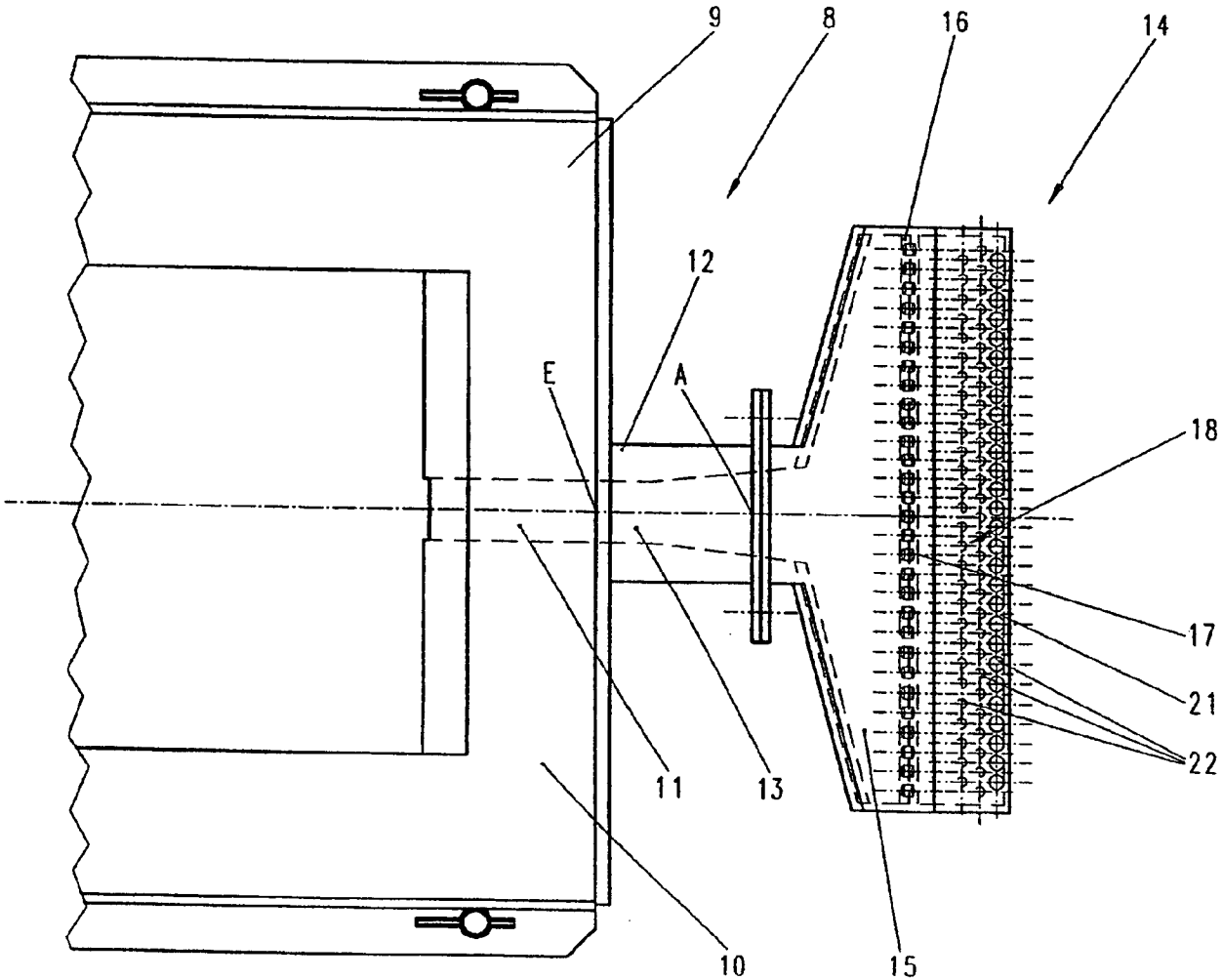
FIG. 2 top view of pouring unit.

The device shown in FIG. 1 consists of a wide strip mold 1 and a pouring unit 8, arranged in line. The pouring unit 8 is shown in FIG. 2 as a detail drawing. The wide strip mold 1 consists of an upper revolving pouring strip 2 and a lower revolving pouring strip 3 which form the upper and lower wall of the mold 1. The endless pouring strips 2, 3 are guided by deflection pulleys, only the front two of which, 4 and 5, are circled in FIG. 1. The mold chamber 6 is limited in its two longitudinal sides by side walls not shown in greater detail which determine the width of the strip to be poured. The mold 1 is arranged for example at an angle of 9° inclined to the horizontal. The molten metal between the pouring strips 2 and 3 is moved in the direction of the discharge of the strip and solidified by cooling. The filling level or bath surface in mold 1 is denoted by the reference numeral 7.

The discharge or strip speed of the pouring strips 2, 3 depends on the width and thickness of the strip to be poured.

The pouring unit 8 (FIG. 2) intended for feeding the molten metal to mold 1 consists of a distribution container 9, a connecting piece 12 and a pour nozzle 14.

Figure 9:
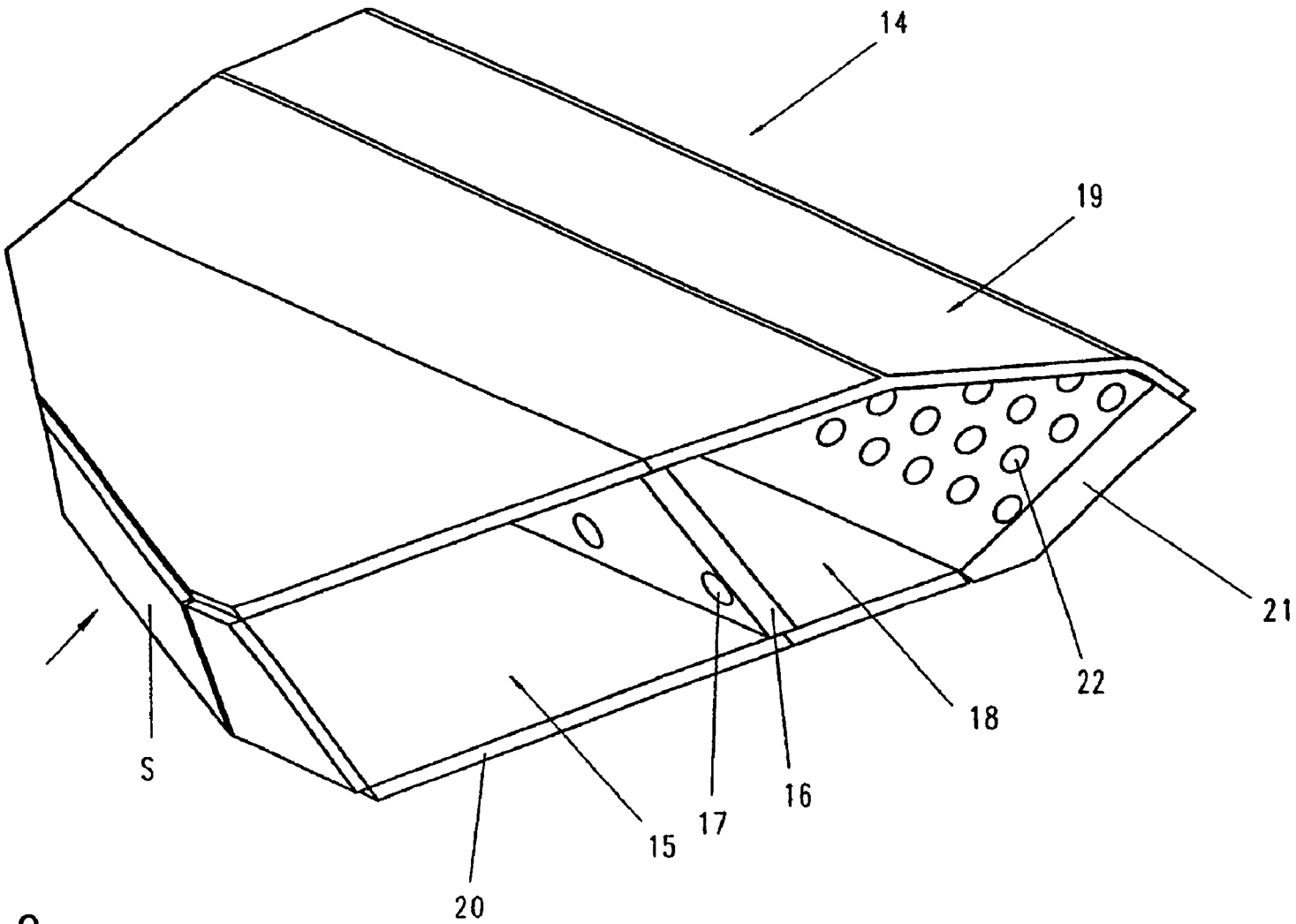

The distribution container 9 has a centrally arranged pouring channel 11 running diagonally upwards with a rectangular cross sectional area in the wall section 10 pointing in the direction of the mold 1. The connecting piece 12, which has a pouring channel 13, is connected to the distribution container 9. The pouring channel 13 has the same cross sectional dimensions as the pouring channel 11 at the connection point of the connecting piece 12. The pouring channel 13 then increases in width as shown in FIG. 2. The pouring channel 13 runs parallel to the horizontal or to the bath surface 7 of the mold 1. The pouring channel acts as a diffuser because of the continuous widening of the cross section of the pouring channel 13 in the direction of the pour nozzle 14. The pour nozzle 14 is flange-connected to the end of the connecting piece 12. The pour nozzle 14 is arranged at an angle sloping slightly downwards, for example at 9°, and extends right up to the height of the bath surface 7 of the mold 1. The pour nozzle 14 shown in FIGS. 1, 2 and 9 is divided into a distribution section 15 and a discharge section 18. The distribution section 15 is constructed in such a manner that the pour nozzle 14 extends in width to the width of the strip to be poured. The height of the channel in the distribution section 15 remains unaltered and corresponds to the height of the pouring channels 11 and 13. The pour nozzle 14, whose width is adjusted to the strip width to be poured, has a length of approximately 150 to 200 mm for example. The length of the distribution section is about 60% of the length of the pour nozzle.

A supply flow restrictor 16 is arranged at the end of the distribution section 15 extending over the entire cross section. The supply flow restrictor 16 has a specific wall thickness, for example 6 to 8 mm, and openings 17 arranged in the vicinity of the base. The individual openings or holes 17, which are arranged next to each other, have identical cross sectional areas and are equally spaced. The sum of the cross sectional areas of the throughflow openings amounts for example to 0.9 to 0.94 times the inlet cross section of the pouring channel 13.

Figures 3, 4, 5:
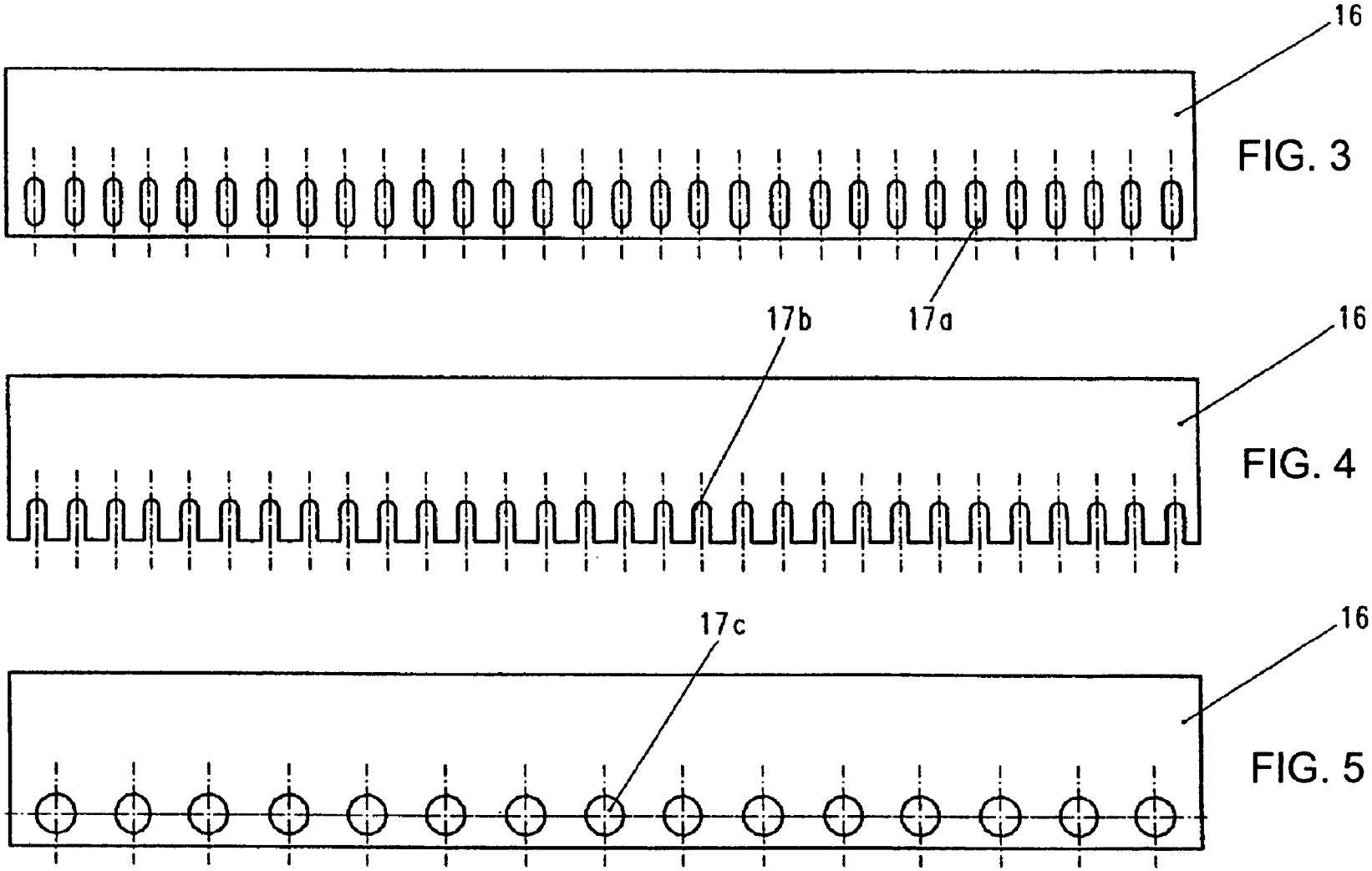
FIG. 3 front view of an initial model variant of the supply flow restrictor, FIG. 4 front view of a second model variant of the supply flow restrictor, FIG. 5 front view of a third model variant of the supply flow restrictor, FIG. 6 top view of an initial model variant of the outlet flow restrictor, FIG. 7 top view of a second model variant of the outlet flow restrictor, FIG. 8 top view of a third model variant of the outlet flow restrictor and FIG. 9 perspective view of a section of the pour nozzle.

FIGS. 3 to 5 show different model variants of the supply flow restrictor 16. The supply flow restrictor 16 shown in FIG. 3 has elongated holes 17*a*. A second model variant (FIG. 4) is fitted with shortened elongated holes 17*b* extending to the base section 20 of the pour nozzle 14 and arranged in the shape of a "comb". A third model variant (FIG. 5) has circular holes 17*c*.

Figure 6:
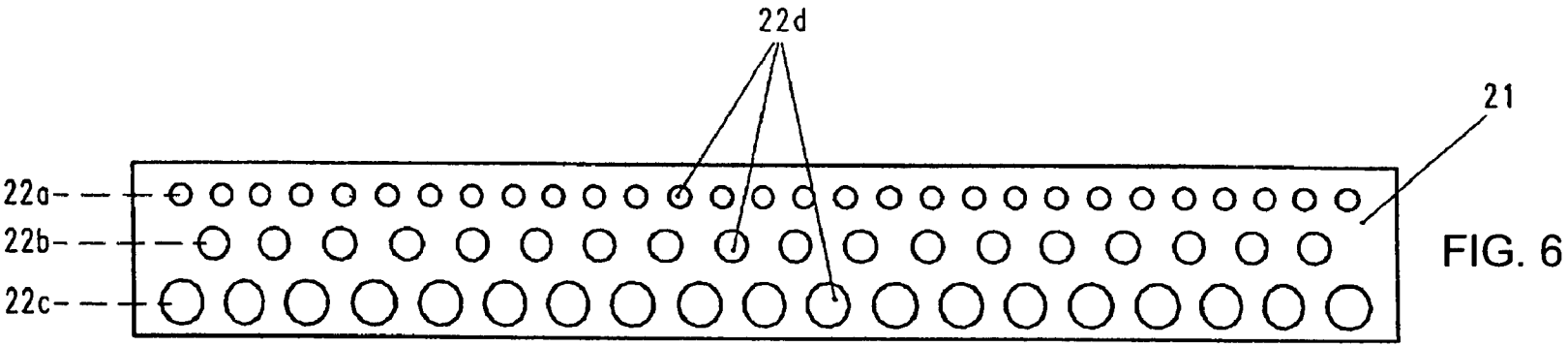
Figure 7:
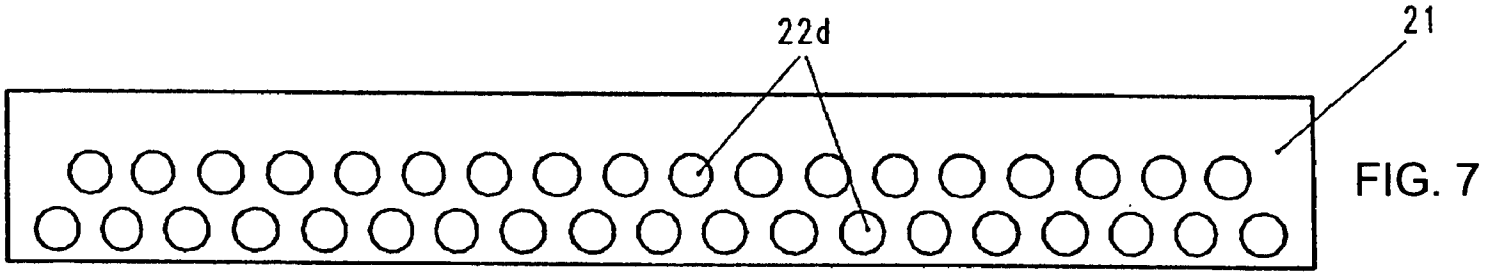
Figure 8:
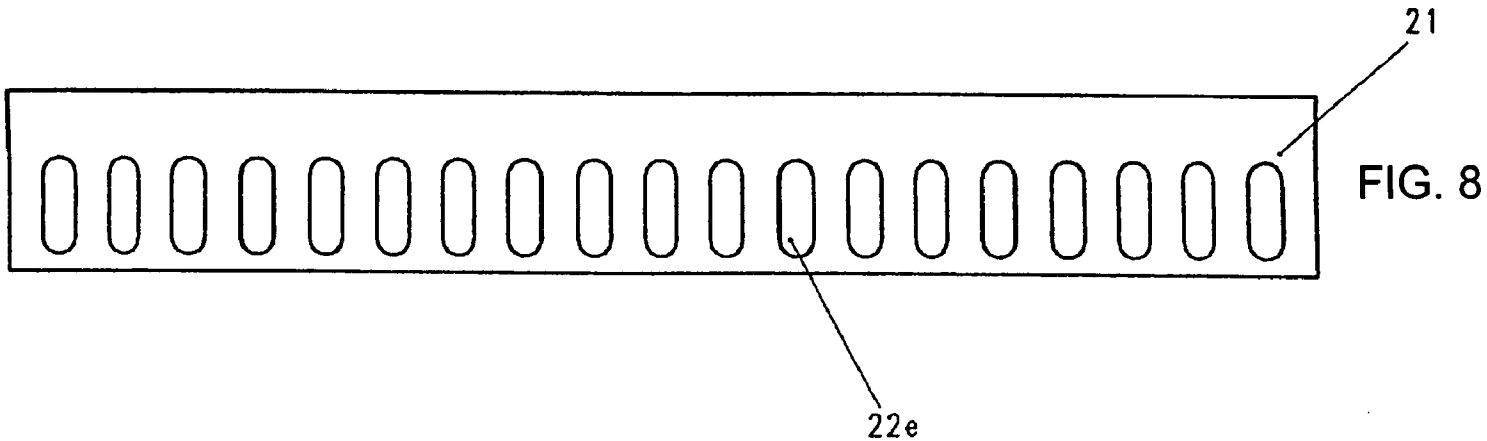

The discharge section 18 connecting to the distribution section 15 has a spout 19 tapering in the direction of the mold 1, as shown in FIG. 1. A discharge strip 21 bent upwards is connected to the base section 20, said discharge strip being formed as an outlet flow restrictor with a specific wall thickness. The angle of inclination or opening angle $\alpha$ of the discharge strip 21 is about 15 to 30°, with respect to the bath surface 7 of the mold 1. The discharge strip 21 has several outlets 22 along the width of the strip to be poured. FIGS. 6 to 8 show different model variants of the outlet flow restrictor or discharge strip 21. The discharge strip 21 shown in FIG. 6 has three rows 22*a*, 22*b*, 22*c* on circular outlets 22*d*. The openings within a row are identically formed. The row 22*a* arranged at the lowest point of the discharge strip 21 has the smallest openings, the following rows 22*b* and 22*c* each have openings with larger diameters. The openings decrease in number as their diameters increase.

The discharge strip shown in FIG. 7 has two rows with identical, circular outlets 22*d* arranged in a staggered manner to each other.

The discharge strip shown in FIG. 8 has only one row of outlets, with the identical openings 22 constructed as elongated holes 22*e*.

The arrangement and design of the outlets of the outlet flow restrictor or discharge strip is determined by means of special calculation models, taking into account the fact that the average discharge speed of the molten metal after leaving the outlet flow restrictor should be under 0.1 m/s. The outlet flow restrictor 21 should preferably have a thickness of about 6 to 10 mm and a conical shape running from the exterior to the center in order in order to create a gradient flow. The outlets or holes can be arranged inclined at an angle of 12 to 20° against the direction of flow.

The flow path of the liquid copper melt during the pouring process is as follows:

The liquid molten metal is contained in the distribution container or tundish 9 at a defined filling level H. It is important in this respect that the molten metal in the distribution container 9 be kept at a constant level H during the continuous pouring process, with pouring unit 8 and strip mold 1 arranged in such a manner that a difference in level N of 75 to 90 mm is maintained (FIG. 1) between the bath surface 7 of the mold 1 and filling level H in the distribution container 9. The filling level H in the distribution container 9 is therefore at least the same height as the upper limit of the pouring channel 11 at the outlet of the distribution container 9. This ensures, on the one hand, that no air can be introduced into the molten metal in the distribution container 9. On the other hand, this difference in level ensures a flow rate of the molten metal that is advantageous for the pouring process since it is not excessively high. The flow rate of the molten metal is directly proportional to the difference in level N. The molten metal flows upwards through the pouring channel 11 because of the metallostatic pressure in the distribution container 9. This is constantly filled full of molten metal during the pouring process. The pour nozzle 14 can also be directly connected to the distribution container 9. In the version of the distribution container 9 shown in FIG. 1 it is however advantageous to arrange a connecting piece 12 between tundish 9 and pour nozzle 14. Where a connecting piece 12 is arranged in this way, it is advantageous if the pouring channel 13 in such a connecting piece runs parallel to the horizontal. The volume flow of the molten metal depends on the dimensions of the strip to be produced which is determined by the preset pouring output. In the connecting piece 12 envisaged the strand-like volume flow is evenly distributed because of the pouring channel 13 that extends in width as its height reduces.

Dependent on the pouring output, the pouring channel 13 should be designed in such a manner that a ratio of flow rate to volume flow of 1:4 to 1:3 and 1:1.5 to 1:2 is maintained (FIG. 2) at the entry point E of the pouring channel 13 and at the exit point A respectively.

On entering the pour nozzle 14, the molten metal is continuously distributed in the distribution section 15 over the entire width of the pour nozzle 14 which corresponds to the width of the strip to be poured. In this process the volume flow is evenly distributed continuously on both sides. In FIG. 9 the molten metal feed is indicated by an arrow. The inlet cross section S of the pour nozzle 14 is identical to the outlet cross section A of the connecting piece 12. The pour nozzle 14 is enclosed on both its longitudinal sides (in the direction of flow) by means of side walls that are not shown in FIG. 9.

A supply flow restrictor 16 with openings 17 is arranged at the end of the distribution section 15. When the molten metal flows through the openings 17, the kinetic energy of the molten metal flow is dissipated and the partial flows discharging from the flow restrictor 16 flow at a reduced flow rate and combine to form an even volume flow extending over the entire width of the discharge section 18.

As regards the material thickness or depth of the supply flow restrictor 16, by which the flow path length within the flow restrictor is determined, and the size of the cross sectional areas of the openings 17, 17*a*, 17*b*, 17*c*, the supply flow restrictor should be designed in such a manner as to maintain a ratio of outlet cross sectional area to volume flow of 1:8 to 1:12. The outlet cross sectional area is derived from the sum of the individual cross sectional areas of the openings 17, 17*a*, 17*b*, 17*c* of the flow restrictor 16. The supply flow restrictor 16 therefore also distributes the molten metal symmetrically over the entire width of the discharge section 18 of the pour nozzle 14, with a continuous volume flow being established in the process. The molten metal is evenly thermally loaded as it flows through the supply flow restrictor 16. This practically eliminates deformations of the pour nozzle 14 caused by material stresses. The increase in temperature of the molten metal caused by the supply flow restrictor 16 renders continuous heating of the pour nozzle 14 during pouring unnecessary. During pouring the discharge section of the pour nozzle need not be completely filled with molten metal, the filling level should however be at least 50%.

The molten metal is redirected in the direction of the mold bath surface by the discharge strip 21 inclined at an angle in the discharge section 18 with the outlets 22. The molten metal is divided into small vertical individual flows by the outlets 22, the said flows being distributed evenly over the entire width of the strip as a laminar flow. At the same time, the discharge strip further reduces the flow rate. The pour nozzle 14 is arranged in such a manner that at least the lowest point of the discharge strip 21 is in direct contact with the bath surface 7 of the mold 1. A type of wedge of molten metal is formed as an outflow profile between the discharge strip 21 and the bath surface 7 by the opening angle α of the discharge strip 21. The molten metal fed in reaches the mold bath as a quiescent even flow. The flow rate of the molten metal after discharge from the openings 22 of the outlet flow restrictor 21 corresponds approximately to the discharge speed of the finished strip.

The flow rate of the molten metal can be matched as required to the respective production-specific conditions by alterations to the material thickness or depth of the supply flow restrictor 16 and outlet flow restrictor 21 based on calculations and preliminary tests. Turbulences in the pool of the mold are largely eliminated by feeding in the molten metal as a laminar flow which forms a wedge of molten metal. An even heat input is established by the outflow profile formed as a molten metal wedge over the entire width of the mold so that the introduction of liquid metal into the pool has no adverse effects on the quality of the mold structure. Because of the reduction in the flow rate of the liquid molten metal and the formation of a wedge-shaped outflow profile, the danger of turbulences forming in the pool of the mold is practically eliminated. The maximum height of the outflow profile or wedge of molten metal, which is determined by the opening angle α (15 to 30°) of the discharge strip 21, depends on the material thickness of the strip to be poured and should be so set that a ratio of distance/strip thickness of 1:1.5 to 1:1.1 is maintained at the point of the smallest distance to the bath surface 7.

The method proposed and associated device are particularly suited for the production of copper strips with a width of 1000 to 1300 mm and a thickness of 30 to 50 mm. The measures proposed therefore make it possible to produce strips of copper or copper alloys with no cavities or cracks to impair quality.

The invention claimed is:

1. A method for producing wide strips of copper or copper alloys, which comprises the steps of:

guiding a molten metal from a distribution container into a lower wide strip mold via a pour nozzle inclined at an angle;

maintaining a surface of the molten metal in the distribution container at a constant level above a place where the pour nozzle is fixed in the distribution container in a range of 75 mm to 90 mm with respect to a level of a mold bath surface of the lower wide strip mold;

guiding the molten metal by an ascending channel from the distribution container to the pour nozzle and the molten metal is distributed within the pour nozzle symmetrically over a width which corresponds to a width of a strip to be produced; and guiding the molten metal within the pour nozzle through at least one first flow restrictor and redirected at an exit point of the pour nozzle through a second flow restrictor in a direction of the mold bath surface and separated into numerous small individual flows in a vertical direction over an entire strip width of the lower wide stripe mold, the individual flows being carried into a molten metal bath of the lower wide stripe mold as a laminar flow which forms a wedge-type outflow profile with an opening angle, running in a direction of discharge of the lower wide stripe strip, of between 15° to 30° to the mold bath surface of the lower wide stripe mold.

2. The method according to claim 1, wherein outlets of the pour nozzle are located above the mold bath surface of the lower wide stripe mold, with a distance of the pour nozzle from the mold bath surface at a smallest point set at a ratio of distance/thickness of 1:1.5 to 1:1.1, dependent on a thickness of the strip to be poured.

3. The method according to claim 2, which further comprises partly immersing the outlets of the pour nozzle in the mold bath surface of the lower wide stripe mold.

4. The method according to claim 1, wherein before entering the pour nozzle the molten metal flows through a channel running parallel to a horizontal, which extends in width in the direction of flow.

5. The method according to claim 1, wherein the molten metal in a form of the individual flows disposed in a form of rows is discharged from the pour nozzle.

6. The method according to claim 4, which further comprises maintaining a ratio of flow rate to volume flow of 1:4 to 1:3 and of 1:1.5 to 1:2 at an entry point of the channel and at an exit point of the channel respectively.

7. The method according to claim 1, which further comprises configuring the first flow restrictor with regards to a material thickness and cross sectional areas of openings in the first flow restrictor such that a ratio of outlet cross sectional area to volume flow of 1:8 to 1:12 is maintained, with the outlet cross sectional areas being derived from a sum of the individual cross sectional areas of the openings of the first flow restrictor.

8. The method according to claim 1, which further comprises selectively influencing a flow rate of the molten metal by flow paths of different lengths within the first and second flow restrictors.

9. The method according to claim 1, which further comprises reducing a flow rate of the molten metal after discharging from the pour nozzle to a value that corresponds approximately to a discharge speed of the lower wide stripe mold or is close to it.

10. A device for producing wide strips of copper or copper alloys, the device comprising:

a distribution container filled with a liquid molten metal;

a pour nozzle disposed downstream of said distribution container, said distribution container and said pour nozzle forming a pouring unit, said pour nozzle having a distribution section and a discharge section, with said distribution section increasing in width up to a width of a strip to be poured;

a revolving wide strip mold disposed downstream of said pour nozzle and having a bath surface;

said pour nozzle running diagonally downwards at a defined angle of inclination;

said pouring unit disposed in such a manner that there is a difference in level of 70 to 95 mm between said bath surface of said revolving wide strip mold and a filling height;

an ascending outlet channel disposed in said distribution container;

said pour nozzle having a first flow restrictor extending over an entire cross sectional area and having through-flowable openings formed therein and disposed between said distribution section and said discharge section;

said discharge section having a spout tapering in a direction of said revolving wide strip mold, and a lower limit of said spout running diagonally upwards at a defined angle and fitted as a discharge strip with openings formed therein pointing in a direction of said bath surface.

11. The device according to claim 10, wherein said discharge strip is disposed at an opening angle of 15 to 30° to said bath surface of said revolving wide strip mold.

12. The device according to claim 10, wherein a lowest point of said discharge strip is above said bath surface, at a distance from said bath surface corresponding to 0.9 to 0.5 times a thickness of the strip to be poured.

13. The device according to claim 10, wherein a lowest part of said discharge strip is in contact with said bath surface.

14. The device according to claim 10, wherein said discharge strip is partly immersed in said bath surface.

15. The device according to claim 10, wherein said openings of said discharge strip are disposed in a row, with said openings within said row being of identical design.

16. The device according to claim 10, wherein said openings of said discharge strip have different cross sectional areas.

17. The device according to claim 10, wherein:

said pour nozzle has a base section; and said openings of said first flow restrictor are disposed in a row and in an immediate vicinity of said base section of said pour nozzle.

18. The device according to claim 10, wherein:

said pour nozzle has a base section; and said openings of said first flow restrictor are disposed in a row and limited by said base section of said pour nozzle.

19. The device according to claim 10, further comprising:

a connecting piece; and a pouring channel, said connecting piece with said pouring channel are disposed between said distribution container and said pour nozzle.

20. The device according to claim 19, wherein said pouring channel is disposed in said connecting piece and runs parallel to a horizontal and continues to increase in width in a direction of flow.

* * * * *